US009382650B2

(12) United States Patent
Tseng

(10) Patent No.: US 9,382,650 B2
(45) Date of Patent: Jul. 5, 2016

(54) CUTTING DEVICE FOR A SEWING MACHINE

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 623 days.

(21) Appl. No.: 13/838,178

(22) Filed: Mar. 15, 2013

(65) Prior Publication Data

US 2014/0261122 A1 Sep. 18, 2014

(51) Int. Cl.
*D05B 65/00* (2006.01)
*D05B 37/06* (2006.01)

(52) U.S. Cl.
CPC ..... *D05B 65/00* (2013.01); *D05B 37/06* (2013.01); *D05B 37/063* (2013.01)

(58) Field of Classification Search
CPC ..... D05B 37/04; D05B 37/06; D05B 37/063; D05B 37/08
See application file for complete search history.

(56) References Cited

U.S. PATENT DOCUMENTS 5,289,789 A * 3/1994 Sakuma ..... D05B 37/063 112/122
6,892,658 B1 * 5/2005 Chang ..... D05B 37/06 112/122
6,981,458 B2 * 1/2006 Ebata ..... D05B 37/063 112/122

FOREIGN PATENT DOCUMENTS

TW M563703 U1 11/2003

* cited by examiner

*Primary Examiner* — Nathan Durham
(74) *Attorney, Agent, or Firm* — Banger Shia

(57) ABSTRACT

A cutting device for a sewing machine includes an upper-blade positioning device and a lower-blade positioning device. The upper-blade positioning device includes an upper blade upper blade fixed at a head portion of the upper-blade holder, and a spring and a restricting member sleeved on a body portion of the upper-blade holder. A restricting pin is engaged between an upper-blade drive member and the restricting member. A guide member includes a guide hole for insertion of a rod portion of the upper-blade drive member and is fixed to the base. The upper-blade drive member is inserted through a guide member of the base and moved by a connecting rod. The lower-blade positioning device includes a lower-blade holder, an adjustment member. A lower-blade shaft has one end fixed to the base and another end extended out of the base, rotating the adjustment member can adjust the position of the lower-blade holder.

4 Claims, 8 Drawing Sheets

CUTTING DEVICE FOR A SEWING MACHINE

BACKGROUND OF THE INVENTION

1. Field of the Invention

The present invention relates to a sewing machine, and more particularly to a cutting device for a sewing machine.

2. Description of the Prior Art

The applicant's former invention called "cutting structure for a sewing machine" has been patented in Taiwan with the patent serial No. 90224753 and another invention called "sewing machine" has also been patented in USA with the patent No. 6892658. Both inventions are invented based on the working principle of the four-bar linkage mechanism to make the upper blade move stably, and allow the lower blade to be adjusted in position with respect to the needle plate.

However, the applicant of the present invention is not satisfied with the improvement made in the Taiwan Patent serial No. 90224753 and has made further improvement to the sewing machine of Patent No. 6892658.

The present invention has arisen to mitigate and/or obviate the afore-described disadvantages.

SUMMARY OF THE INVENTION

The primary objective of the present invention is to provide a cutting device for a sewing machine, wherein the upper-blade drive member cooperates with the guide member which is fixed on the base to enhance the stability of movement of the upper blade. The lower-blade positioning device has an adjustment member which is pivoted to the base and screwed with the lower-blade holder, and the adjustment member is rotated by a rotary button. The relative angle between the rotary button and the adjustment member is also adjustable so as to further enhance the rotation-angle adjustment capability of the adjustment member.

To achieve the above objective, a cutting device for a sewing machine, the sewing machine includes a driven shaft and uses an upper-blade drive device to move an upper blade of an upper-blade positioning device mounted on a base of the cutting device, on the base is further disposed a lower-blade positioning device. The upper-blade drive device is linked to a first end of a connecting rod via the driven shaft and a driven member. The upper-blade positioning device includes the upper blade, an upper-blade holder, a spring, a restricting member and a restricting pin, the upper blade is fixed at a head portion of the upper-blade holder, and the spring and the restricting member are sleeved on a body portion of the upper-blade holder. The upper-blade positioning device further includes an upper-blade drive member, the upper-blade holder is inserted through the upper-blade drive member and the spring, and the restricting pin is engaged between the upper-blade drive member and the restricting member. A guide member is fixed to the base, and the upper-blade drive member has one end inserted through a guide member of the base and driven to move by the second end of the connecting rod, and the guide member includes a guide hole for insertion of a rod portion of the upper-blade drive member.

Another objective of the present invention is to provide a cutting device for a sewing machine, wherein the upper-blade positioning device is simplified, the upper-blade drive member is integrally designed and provided for mounting of relative parts of the upper-blade positioning device, so as to simplify the structure of the upper-blade positioning device while reducing relative manufacturing and assembling cost.

Another objective of the present invention is to provide a cutting device for a sewing machine, wherein the lower blade can be adjusted more efficiently. With the arrangement of the rotary button, the adjustment member, and the threaded engagement between the adjustment member and the lower-blade holder, the lower-blade holder can be adjusted more quickly and precisely.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
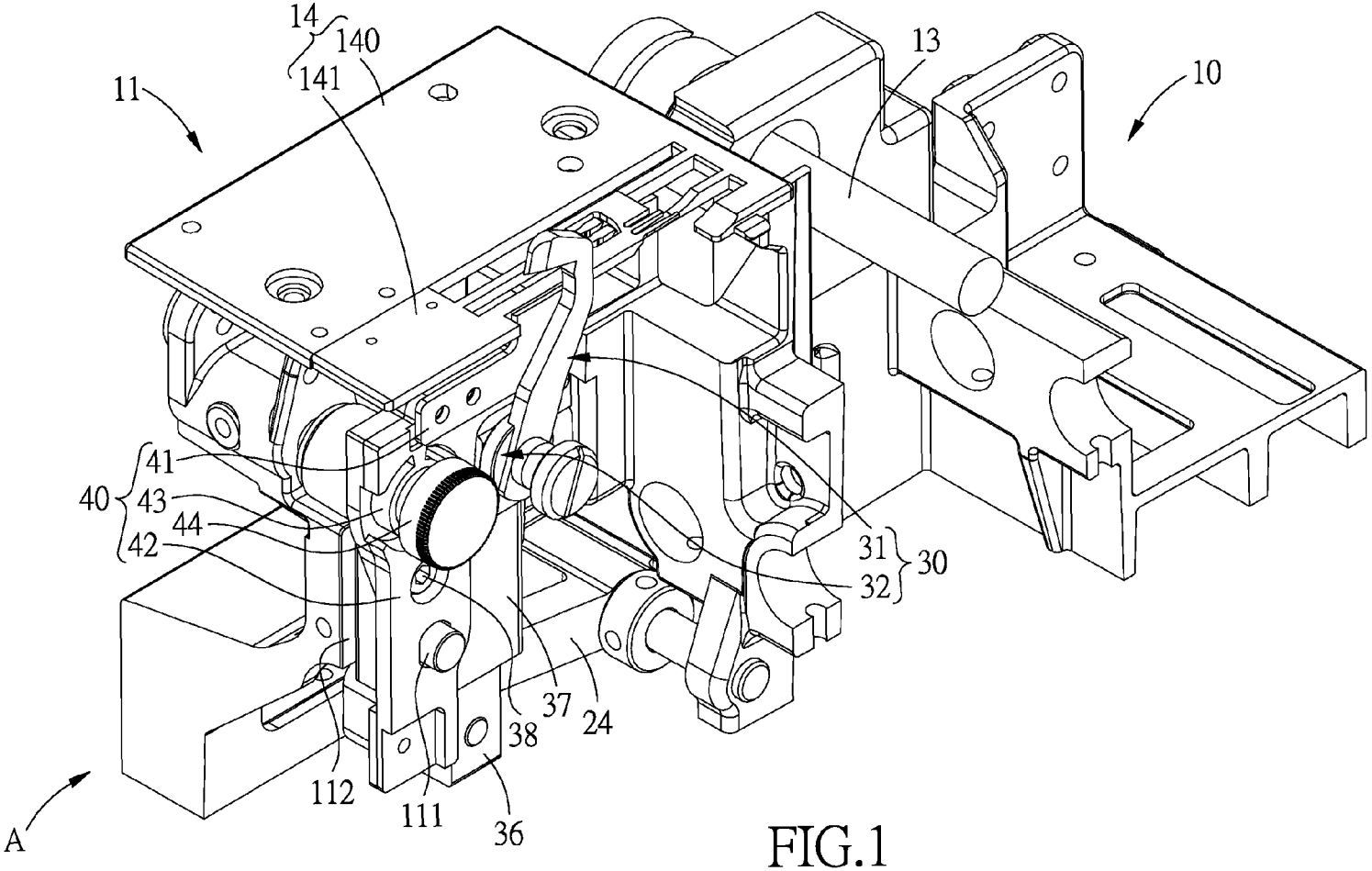
FIG. 1 is a perspective view of a cutting device for a sewing machine in accordance with the present invention.
Figure 2:
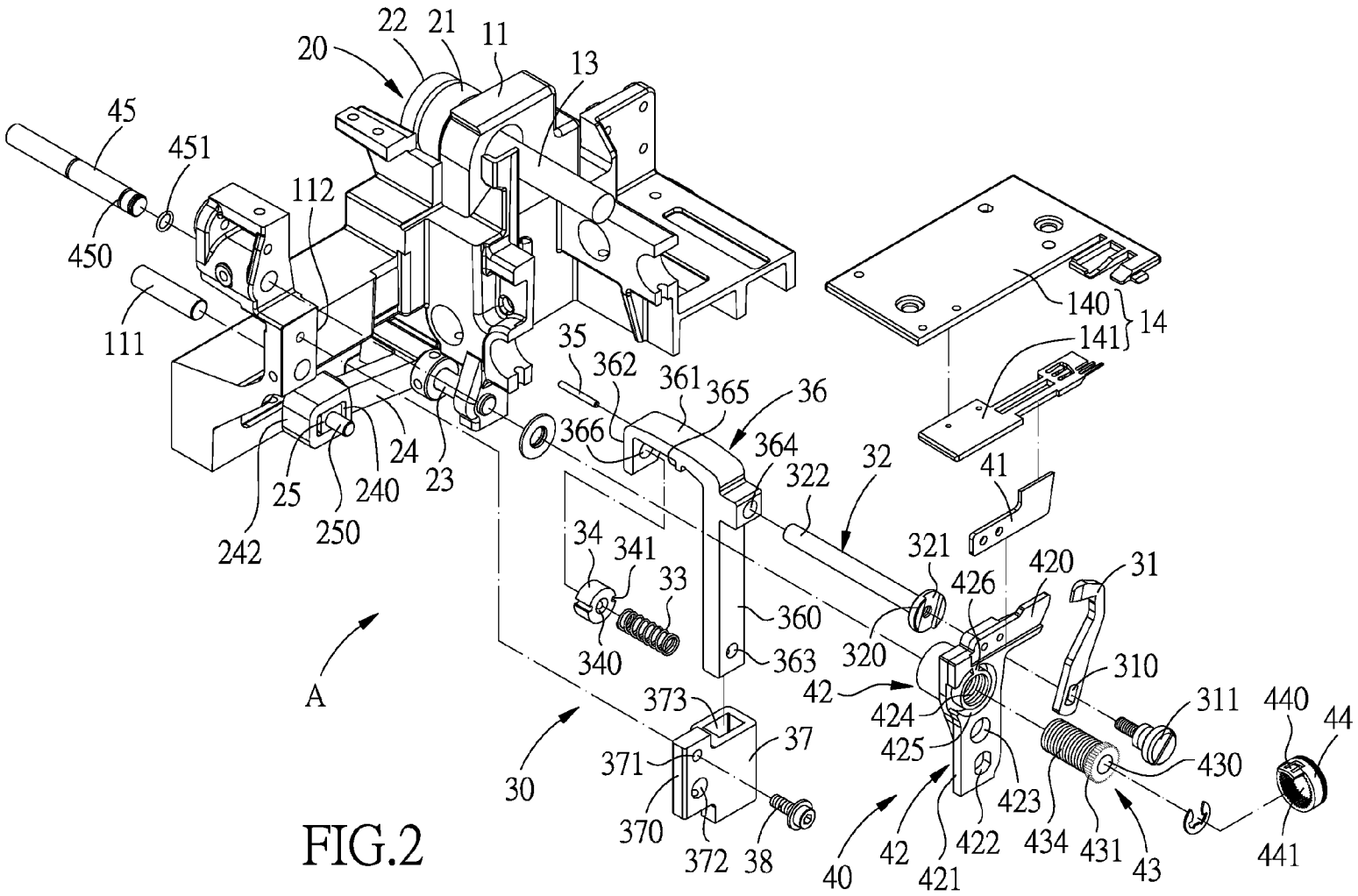
FIG. 2 is an exploded view of the cutting device for a sewing machine in accordance with the present invention.
Figure 3:
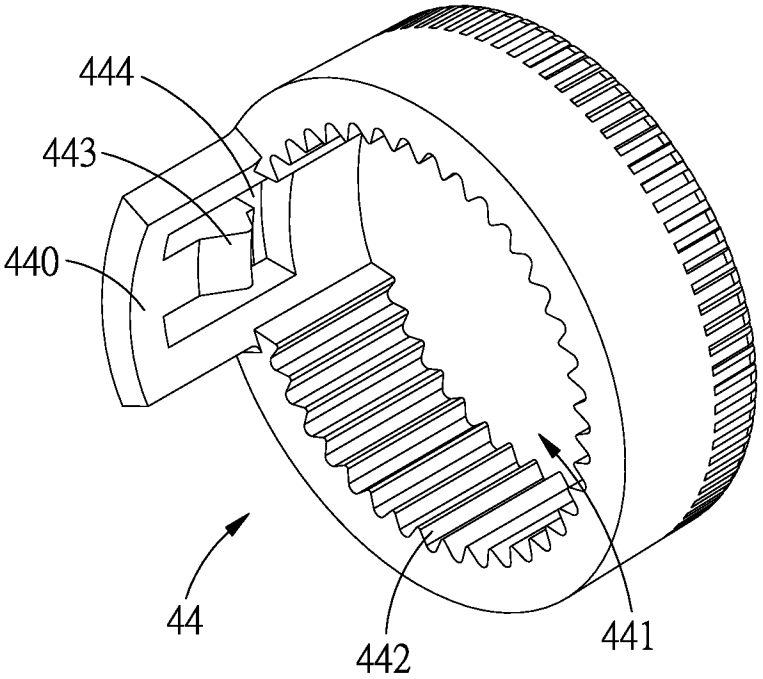
FIG. 3 shows a rotary button of the cutting device for a sewing machine in accordance with the present invention.

Referring to FIGS. 1-3, a cutting device A for a sewing machine 10 in accordance with the present invention is disposed in a base 11 of the sewing machine 10. A cantilever extends from the base 11, and a driven shaft 13 is disposed inside the base 11 to simultaneously drive the drive parts which are disposed inside the base 11 and the cantilever. At a free end of the cantilever is fixed a needle (not shown) which repeatedly moves and down, the cutting device A is located under the needle, and above the needle is a needle plate 14 which includes a first part 140 and a second part 141. The cutting device A includes an upper blade 31 and a lower blade 41 and devices for moving and positioning the upper and lower blades 31, 41. In the base 11 is further disposed an upper-blade drive device 20 of the cutting device A to move the upper blade 31, and the upper-blade drive device 20 is rotated by the driven shaft 13. The base 11 is also provided with an inserting shaft 111 and a stepped engaging portion 112, and the inserting shaft 111 and the engaging portion 112 are provided for mounting of an upper-blade positioning device 30 and a lower-blade positioning device 40, respectively. In the upper-blade positioning device 30 is disposed the upper blade 31 which is adjustable in position and can be fixed in placed again after adjustment, and in the lower-blade positioning device 40 is disposed a lower blade 41 which is adjustable in position and can be fixed in placed again after adjustment. The present invention is characterized in that, with the arrangement of the upper-blade positioning device 30 and the lower-blade positioning device 40, transmission of motion of the upper and lower blades 31, 41 can be more stabilized and simplified.

The driven shaft 13 inside the base 11 is driven by a power source in the form of a motor and has one end linked to the upper-blade drive device 20 which includes a drive member 21 in the form of a cam, and an annular driven member 22 sleeved on the drive member 21. The upper-blade drive device 20 is fixed to the driven shaft 13 by a bolt inserted through the drive member 21. The driven member 22 has a lower end driven by a first end 241 of a connecting rod 24, and in the middle of the connecting rod 24 is disposed a pivot 23 with two ends pivoted to the base 11. A second end 242 of the connecting rod 24 is formed with an elongated slide groove 240, and a power transmission member 25 has a square end slidably disposed in the slide groove 240 and has a pivot portion 250 extending toward the upper-blade positioning device 30 of the cutting device A.

The upper-blade positioning device 30 includes the upper blade 31, an upper-blade holder 32, a spring 33, a restricting member 34 and a restricting pin 35. The upper blade 31 is formed at an end thereof with an elongated adjustment hole 310. The upper-blade holder 32 includes a head portion 320 in which being formed a positioning groove 321, and a body portion 322 whose diameter is smaller than the head portion 320. The upper blade 31 is fixed in the positioning groove 321 of the upper-blade holder 32 by an adjustment bolt 311 inserted through the adjustment hole 310 of the upper blade 31. The body portion 322 of the upper-blade holder 32 is inserted in the spring 33 and a central hole 340 of the annular restricting member 34, and the restricting pin 35 is locked on an outer periphery surface of the restricting member 34. The restricting pin 35 and the upper-blade holder 32 are simultaneously inserted in an upper-blade drive member 36 in such a manner that the spring 33 and the restricting member 34 are sleeved on the upper-blade holder 32. The upper-blade drive member 36 has one end inserted through a guide member 37 of the base 11 and pivoted to the pivot portion 250 of the power transmission member 25, so that motion of the connecting rod 24 can be transmitted to the upper-blade drive member 36 via the power transmission member 25, causing the upper-blade drive member 36 to move along the direction of the guide member 37, namely, the motion direction of the upper-blade drive member 36 is restricted by the guide member 37.

The guide member 37 includes an ear portion 370 in which being formed a first aperture 371 and a second aperture 372 which is located below the first aperture 371 and has a diameter larger than the first aperture 371. A fixing bolt 38 is inserted through the first aperture 371 to fix the guide member 37 to the base 11 in such a manner that the ear portion 370 flatly abuts against the surface of the base 11, and the inserting shaft 111 inserts through the second aperture 372. The ear portion 370 of the guide member 37 is further provided with a guide hole 373 which is square in cross section for insertion of the upper-blade drive member 36, and the guide hole 373 has a certain length, so that the upper-blade drive member 36 can be stably guided to move within the guide hole 373. The outer peripheral surface of the guide hole 373 is abutted against and engaged with the engaging portion 112 of the base 11, so as to fix the guide member 37.

Figure 4:
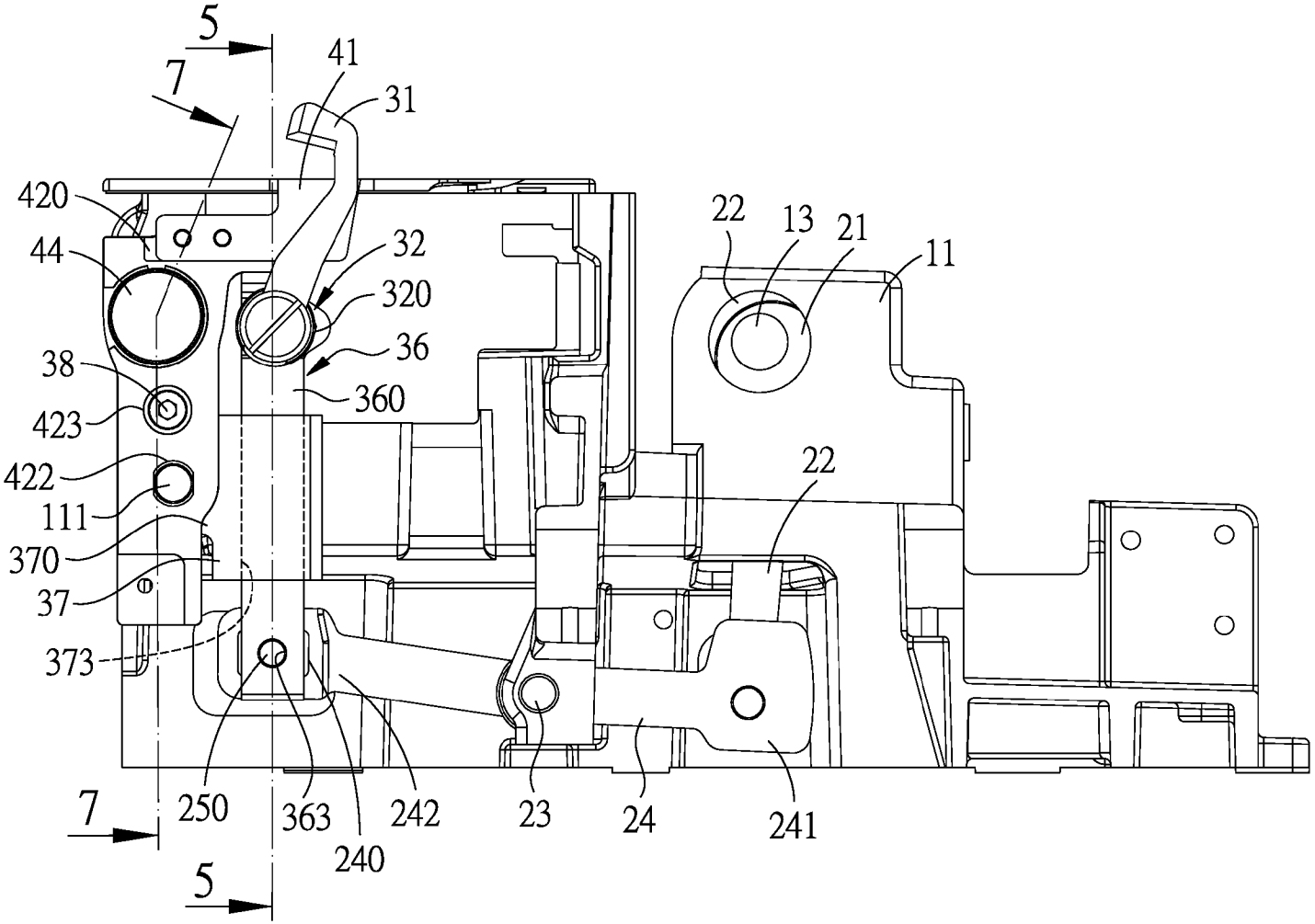
FIG. 4 is a plan view of the cutting device for a sewing machine in accordance with the present invention.
Figure 5:
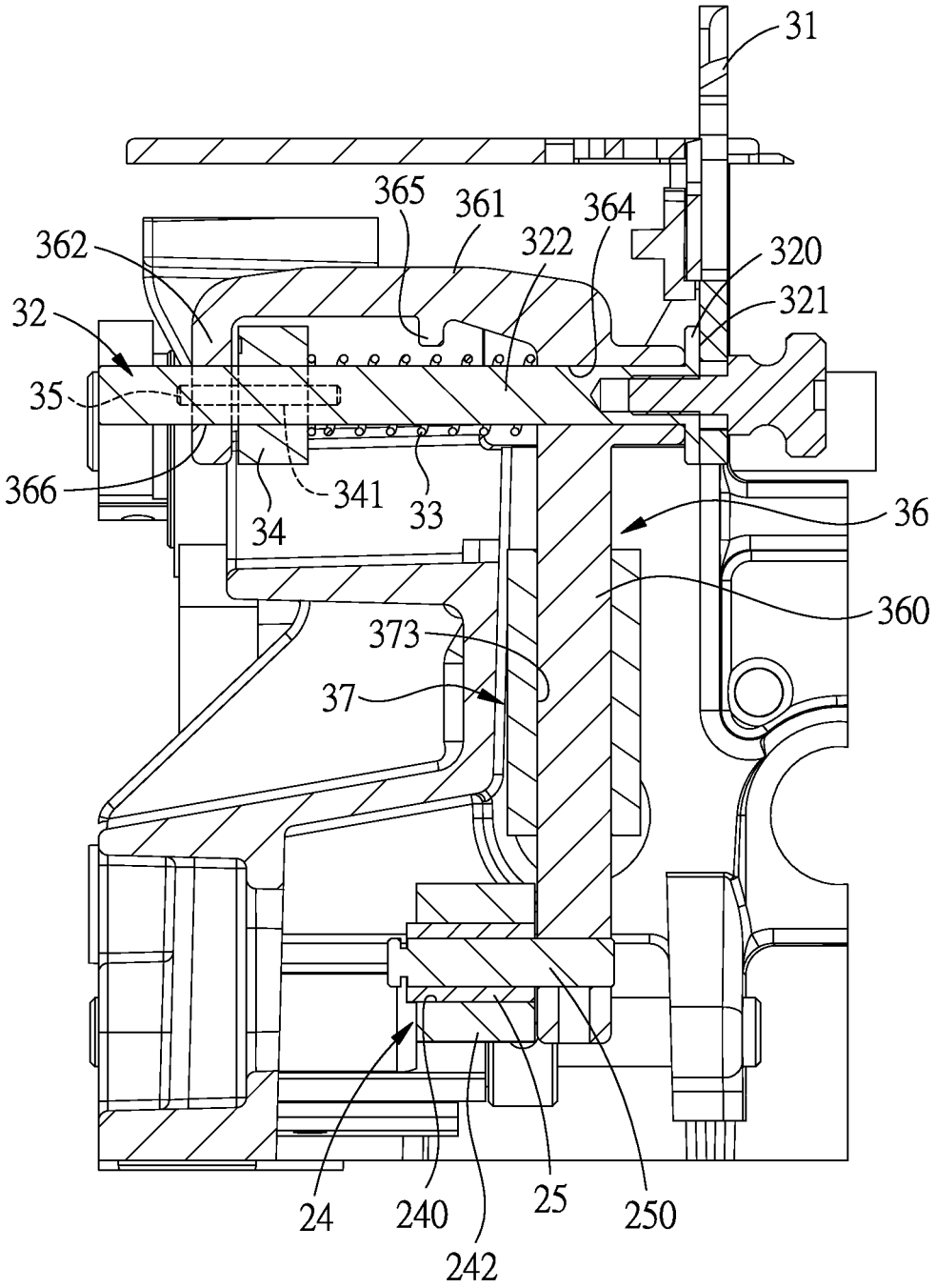
FIG. 5 is a cross sectional view of the upper-blade positioning device of the cutting device for a sewing machine in accordance with the present invention.

Referring then to FIGS. 4 and 5, the upper-blade drive member 36 includes a rod portion 360 extending in a vertical direction and squared in cross section, and an extension portion 361 horizontally extending from the top of the rod portion 360. A free end of the extension portion 361 is folded into a vertical abutting portion 362, so that the upper-blade drive member 36 is roughly a reversely J-shaped structure. The rod portion 360 is longer than the guide hole 373 and restricted by the second aperture 372 to move in vertical direction. At a lower end of the rod portion 360 is formed a pivot hole 363, and the pivot portion 250 is inserted in the pivot hole 363 to drive the upper-blade drive member 36 to move. At the conjunction of the extension portion 361 and the rod portion 360 of the upper-blade drive member 36 is defined a first through hole 364 for passage of the upper-blade holder 32. At the center of the extension portion 361 is formed a flange 365 protruding downward. The abutting portion 362 is formed with a second through hole 366 aligned to the first through hole 364, so that the body portion 322 of the upper-blade holder 32 is inserted in the first and second through holes 364, 366, and the spring 33 and the restricting member 34 are sleeved on the body portion 322 of the upper-blade holder 32 and located between the first and second through holes 364, 366. The spring 33 is biased between the first through hole 364 and the restricting member 34 which is fixed to the upper-blade holder 32 by bolt. When the upper-blade holder 32 is pulled to move along the axial direction of the first and second through holes 364, 366, the travel of the upper-blade holder 32 will be limited by the restricting member 34 which is restricted between the abutting portion 362 and the flange 365. The abutting portion 362 is further formed with a fixing hole (not shown) which is located adjacent to the second through hole 366 for insertion of the restricting pin 35 which extends to the outer periphery surface of the restricting member 34 to restrict the restricting member 34.

Figure 6:
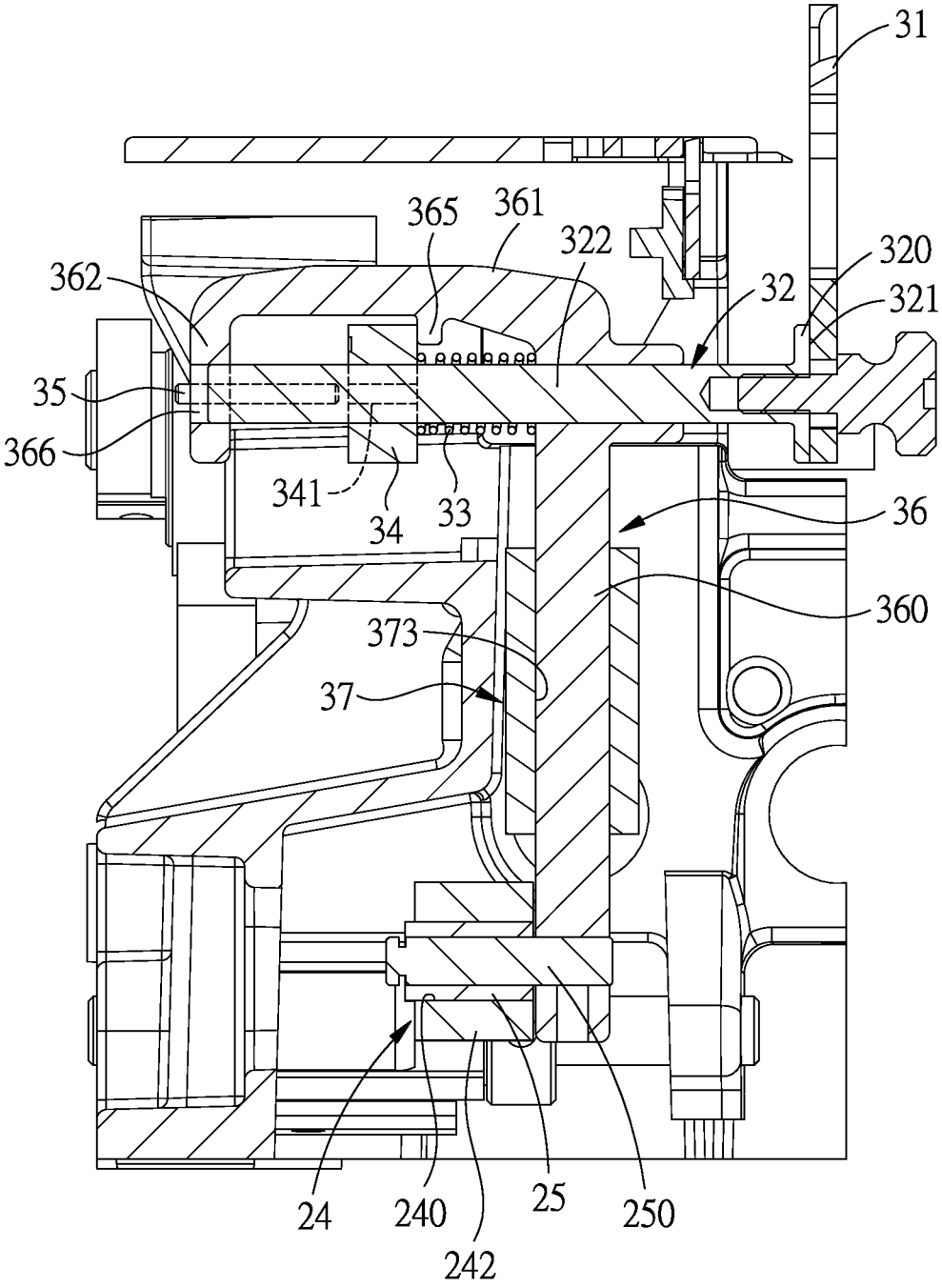
FIG. 6 is another cross sectional view of the upper-blade positioning device of the cutting device for a sewing machine in accordance with the present invention.

The restricting member 34 is an annular structure formed on the outer periphery surface thereof with two opposite restricting grooves 341 which are semicircular in cross section, so that, when the restricting pin 35 is selectively engaged in one of the restricting grooves 341, the upper blade 31 can be moved and positioned at different positions by the upper-blade holder 32 which is linked to the restricting member 34. For example, as shown in FIG. 6, to adjust the position of the upper blade 31, the user can pull the upper-blade holder 32 to move the restricting member 34 from a first position where one of the restricting grooves 341 of the restricting member 34 is engaged with the restricting pin 35, and the restricting member 34 is stopped against the abutting portion 362, to a second position where the restricting member 34 is stopped against the flange 365, meanwhile, the spring 33 is compressed. Then the user rotates the upper-blade holder 32 to make another one of the restricting grooves 341 of the restricting member 34 aligned with the restricting pin 35, at this moment, the user releases the upper-blade holder 32, the restricting member 34 will be pushed by the spring 33 back to the first position and stopped against the restricting member 34 again, and the another one of the restricting grooves 341 of the restricting member 34 will be engaged with the restricting pin 35, thus preventing the upper-blade holder 32 from rotating.

Figure 7:
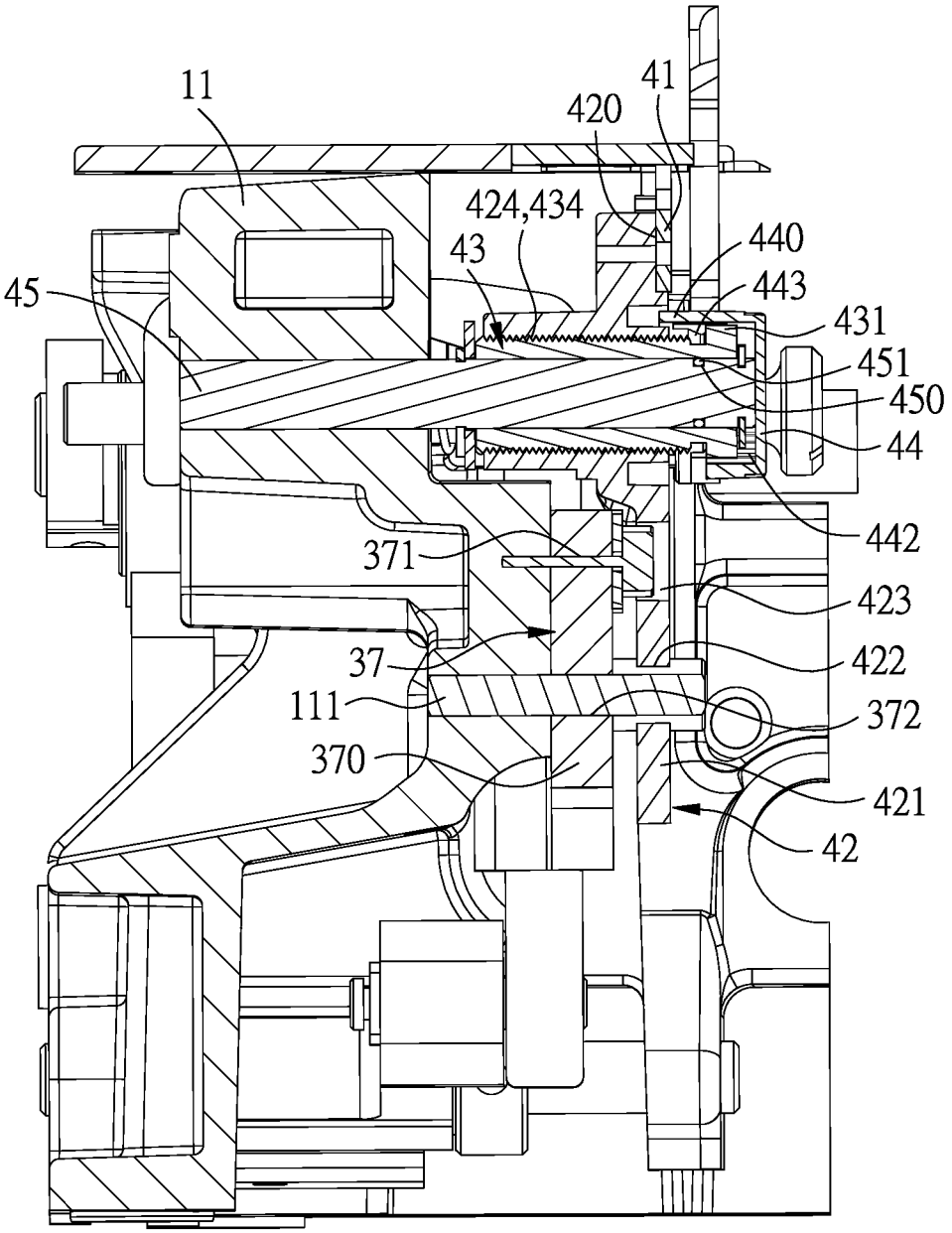
FIG. 7 is a cross sectional view of the lower-blade positioning device of the cutting device for a sewing machine in accordance with the present invention.

The lower-blade positioning device 40 includes a lower blade 41, a lower-blade holder 42, an adjustment member 43 screwed with the lower-blade holder 42, a rotary button 44 covers the adjustment member 43 and is exposed out of the lower-blade holder 42, and a lower-blade shaft 45 fixed to the base 11 and pivotally inserted in the adjustment member 43. As shown in FIG. 7, the lower blade 41 is fixed in a blade-positioning concave 420 which is formed at the top of the lower-blade holder 42 by two bolts. The lower-blade holder 42 is a sheet structure in the shape of an Arabic numeral 7. At a vertical end 421 of the lower-blade holder 42 are formed a vertical elliptical lower hole 422 and a circular upper hole 423 which has an inner diameter larger than the lower hole 422.

The inserting shaft 111 is inserted in the lower hole 422 and the head portion of the fixing bolt 38 is inserted in the upper hole 423. At the folding portion of the lower-blade holder 42 is formed a threaded hole 424, a guide groove 425 formed around the threaded hole 424, and a stop portion 426 formed in the guide groove 425.

The adjustment member 43 is a hollow cylinder formed with an axial hole 430, and the lower-blade shaft 45 is inserted in the axial hole 430 and fixed therein by an E-shaped retainer clipped on the end of the lower-blade shaft 45 extending out of the base 11, so that the adjustment member 43 is pivotally mounted on the lower-blade shaft 45. The adjustment member 43 is formed on a shaft portion with a threaded adjustment portion 434, an outer diameter of the shaft portion of the adjustment member 43 is approximately equal to that of the threaded hole 424, and a head portion of the adjustment member 43 exposed out of the lower-blade holder 42 is formed with a plurality of passive teeth 431.

The rotary button 44 is formed with a cavity 441 and a stop piece 440 extending from a periphery of the cavity 441. The stop piece 440 is to be inserted in the guide groove 425 and stopped against the stop portion 426. The cavity 441 has an inner diameter approximately equal to an outer diameter of the adjustment member 43 and is formed with a plurality of active teeth 442 for meshing with the passive teeth 431, so that the rotary button 44 can rotate the adjustment member 43 to adjust the position of the lower-blade holder 42 with respect to the adjustment member 43. The stop piece 440 is further provided with a flexible locking portion 443. The rotary button 44 is sleeved onto the shaft portion of the adjustment member 43, and the locking portion 443 is engaged with the threaded adjustment portion 434. A slot 444 is formed around the locking portion 443 to make the locking portion 443 flexible.

The lower-blade shaft 45 has one end fixed to the base 11 and has another end extended out of the base 11 and formed with an annular groove 450 for holding of elastic ring 451 which has an outer diameter, so that the elastic ring 451 can partially protrudes out of the annular groove 450 to push against the adjustment member 43, making the adjustment member 43 and the lower-blade shaft 45 more stably assembled together, preventing undesired vibration from occurring between the adjustment member 43 and the lower-blade shaft 45.

Figure 8:
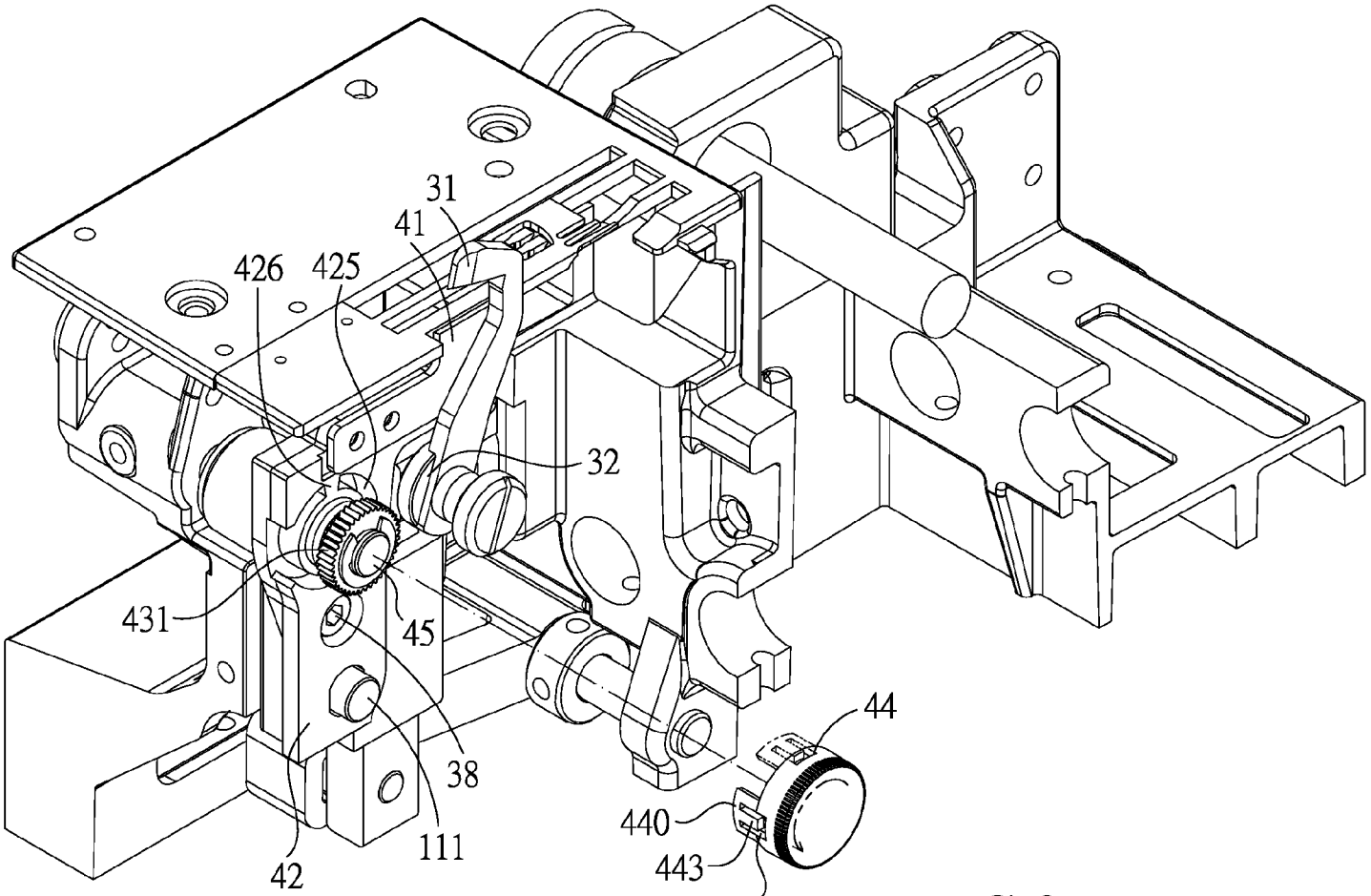
FIG. 8 is another cross sectional view of the lower-blade positioning device of the cutting device for a sewing machine in accordance with the present invention.

When the active teeth 442 of the rotary button 44 are engaged with the passive teeth 431 of the adjustment member 43, the rotary button 44 can rotate the adjustment member 43 to adjust the position of the lower-blade holder 42. If the lower-blade holder 42 has not been adjusted to the desired position after adjustment, the user can pry the locking portion 443 away from the threaded adjustment portion 434 with a tool, and remove the rotary button 44 from the adjustment member 43, as shown in FIG. 8, then rotate the rotary button 44 to a desired angle and push it back to make the active teeth 442 engaged with the threaded adjustment portion 434 again, so that the start point and end point of the rotation travel of the adjustment member 43 are readjusted, and consequently, the adjustment member 43 can be rotated to readjust the position of the lower-blade holder 42.

To summarize, the present invention possess the following advantages:

1. transmission structure is simplified: with the guide member 37 guiding the motion of the upper-blade drive member 36, and with the connecting rod 24 of the upper-blade drive device 20 pivoted to the pivot 23, the transmission structure of the present invention can assuredly be simplified.

2. the upper-blade positioning device is simplified: the upper-blade drive member 36 is integrally designed and provided for mounting of relative parts of the upper-blade positioning device 30, which simplifies the structure of the upper-blade positioning device 30 while reducing relative manufacturing and assembling cost.

3. more efficient adjustment: with the arrangement of the rotary button 44, the adjustment member 43, and the threaded engagement between the adjustment member 43 and the lower-blade holder 42, the lower-blade holder 42 can be adjusted more quickly and precisely.

While we have shown and described various embodiments in accordance with the present invention, it is clear to those skilled in the art that further embodiments may be made without departing from the scope of the present invention.

What is claimed is:

1. A cutting device for a sewing machine, the sewing machine including a driven shaft and using an upper-blade drive device to move an upper blade of an upper-blade positioning device mounted on a base of the cutting device, on the base being further disposed a lower blade to cooperate with the upper blade;

the upper-blade drive device including a driven member linked to a first end of a connecting rod via the driven shaft, and the connecting rod including the first end and a second end;

the upper-blade positioning device including the upper blade, an upper-blade holder, a spring, a restricting member and a restricting pin, the upper blade being fixed at a head portion of the upper-blade holder, and the spring and the restricting member being sleeved on a body portion of the upper-blade holder; the cutting device being characterized in that:

the upper-blade positioning device further includes an upper-blade drive member, the upper-blade holder is inserted through the upper-blade drive member and the spring, the restricting pin is engaged between the upper-blade drive member and the restricting member;

a guide member is fixed to the base, and the upper-blade drive member has one end inserted through the guide member of the base and driven to move by the second end of the connecting rod;

the guide member includes a guide hole for insertion of a rod portion of the upper-blade drive member.

2. The cutting device for the sewing machine as clamed in claim 1, wherein the upper-blade drive member includes an extension portion horizontally extending from a top of the rod portion, and an abutting portion at one end of the extension portion, at a conjunction of the extension portion and the rod portion of the upper-blade drive member is defined a first through hole for passage of the upper-blade holder, the abutting portion is formed with a second through hole aligned to the first through hole, the body portion of the upper-blade holder is inserted in the first and second through holes, the spring and the restricting member are sleeved on the body portion of the upper-blade holder and located between the first and second through holes, and the spring is biased between the first through hole and the restricting member.

3. The cutting device for the sewing machine as clamed in claim 1, wherein a flange is formed at a center of the extension portion, the restricting member is fixed at the upper-blade holder and moves between the first and second through holes, and is restricted between the abutting portion and the flange.

4. The cutting device for the sewing machine as clamed in claim 1, wherein the second end of the connecting rod is formed with an elongated slide groove, and a power transmission member has one end slidably disposed in the slide groove.

* * * * *